United States Patent [19]

Canton

[11] Patent Number: 4,627,557

[45] Date of Patent: Dec. 9, 1986

[54] APPARATUS FOR REVERSING HOSE

[75] Inventor: Armando Canton, Solbiate Arno, Italy

[73] Assignee: Fadis S.p.A., Solbiate Arno, Italy

[21] Appl. No.: 782,297

[22] Filed: Sep. 30, 1985

[30] Foreign Application Priority Data

Sep. 28, 1984 [IT] Italy ..... 22902 A/84

[51] Int. Cl.[4] ..... D05B 21/00

[52] U.S. Cl. ..... 223/39; 223/42

[58] Field of Search ..... 223/39, 40, 41, 42, 223/43; 112/262.2

[56] References Cited

U.S. PATENT DOCUMENTS 4,509,666 4/1985 Rosso ..... 223/39

*Primary Examiner*—Louis K. Rimrodt

*Attorney, Agent, or Firm*—Karl F. Ross; Herbert Dubno

[57] ABSTRACT

Apparatus for turning hose such as socks and stockings inside out, consisting of a drive unit with a gripping device which grips the toe of the hose and moves it between a pair of rotatable rollers which clamp onto the hose. A descending blade is arranged to engage the toe of the hose and to advance it through the nip of the rollers turning the sock inside out as it is wrapped around the blade. The blade is introduced as it descends further between a further pair of rotating rollers arranged to remove the hose which has been turned inside out from the blade.

10 Claims, 9 Drawing Figures

APPARATUS FOR REVERSING HOSE

FIELD OF THE INVENTION

This invention relates to apparatus for reversing or turning inside out, hose such as socks and stockings.

BACKGROUND OF THE INVENTION

In hose production, the hose such as a sock has to be reversed, or turned inside out, at the end of the manufacturing operation for sewing the front end of the sock in the region between the top edge of the toe or "toe-cap" and the top surface edge of the sock, which results in a finishing seam above the toes when the sock is worn on the foot. The sewing operation is usually performed by circular or straight sewing machines, over which the sock is suspended in the area to be sewn.

When sewing is completed, the sock has to be removed from the needles of the sewing machine and reversed or turned inside out again to be sent for pressing and packing. There are numerous machines for carrying out this operation, but they have certain disadvantages in use, due to the possibility of error in inserting the sock between the turning components of the machine, and there is hence a necessity for manual unjamming; as a result there can be numerous rejects.

Some of the well-known machines also have a complex construction and are slow in operation, slowing down the production cycle.

OBJECT OF THE INVENTION

It is an object of this invention to provide apparatus for reversing hose that can remove hose automatically from the sewing machine and reverse it or turn it inside out while holding the hose during the entire cycle, thus avoiding or reducing the risk of blockages of any nature caused by the lack of form of the hose. It is also an object to provide a fairly quick working cycle, which does not unduly limit productivity of the sewing machine.

SUMMARY OF THE INVENTION

According to the invention there is provided apparatus for turning hose inside out, comprising a feed assembly having gripping means arranged to grip the toe of a hose and position it between a first pair of rollers, means for urging the rollers towards each other to grip the hose and means for rotating the rollers in opposite directions. A longitudinally displaceable blade is arranged to engage the toe of the hose and to advance between the rotating rollers whereby the hose is wrapped around the blade to turn it inside out, the blade being introduced as it is displaced between a second pair of rotatable rollers, arranged to remove the hose which has been turned inside out from the blade.

These results can be achieved with an automatic machine according to the invention for reversing, or turning inside out, hose which comprises a feed unit with a gripping means or collet for gripping a hose near the seam on the toe to be sewn by a sewing machine, a pair of traversing rollers for turning the hose inside out which rotate, which can be clamped onto the sock below the collet and can be regulated to rotate in the opposite direction, a pair of opposing, flexibly-mounted plates which can be moved towards the said sock below the turning rollers, a pair of extraction rollers which can be subsequently clamped onto the said hose and a device with a blade which can be lowered vertically by means of an actuator mechanism, which inserts between the toe of the hose and the hose removal, or extraction, rollers, which have a progressive advance.

In more detail, the drive and feed unit comprises a gripping means, or collet which can be traversed from a gripping position above the sewing machine to the release position above the turning rollers, and can be rotated by means of a cam mechanism between a position with the gripper opening plane tangential to the perimeter of the sewing machine and a position with the opening plane parallel to the shaft of the turning rollers during the traversing operation. The collet is fitted with clamps which can be opened by means of a controlled actuator. The turning rollers can be covered in a soft material, rubber or similar, with a surface providing friction on the sock, where necessary with a knurled or rippled surface, and can be clamped together, being supported by levers rotatable around pins and actuated by a pair of actuators. A motor can be linked to the said rollers by means of belts and transmission gears for rotating the turning rollers in opposite directions.

Similarly, the extraction rollers can be equipped with soft coverings, rubber or similar, providing friction on the socks. At least one of the extraction motors can be motorized, and one or other of these, or both, can be moveable by means of actuators acting on levers, the roller or rollers being supported at the end of the levers. The blade device is actuated by an actuator, the first stroke of which moves the end of the said blade onto position below the contact area of the turning rollers, the second stroke moving the end of the blade into position below the contact area of the extraction rollers.

The blade device can have a slight curved section at one end directed towards the part of the sock opposite the heel. In an apparatus according to the invention, there are also control and regulating mechanisms to control the successive movement phases of the collet, closure of the turning rollers and approach of the flexible plates, descent of the blade, rotation of the turning rollers and subsequent arrest, expansion of these, subsequent descent of the blade, approach of the extraction rollers, subsequent rotation of these for unthreading the straightened sock, and return to the initial position. There are also optical sensor mechanisms or similar to register the position of the sock in one or more turning phases and to regulate the control mechanisms.

BRIEF DESCRIPTION OF THE DRAWING

The invention will now be described by way of example with reference to the accompanying drawing in which.

SPECIFIC DESCRIPTION

Figure 1:
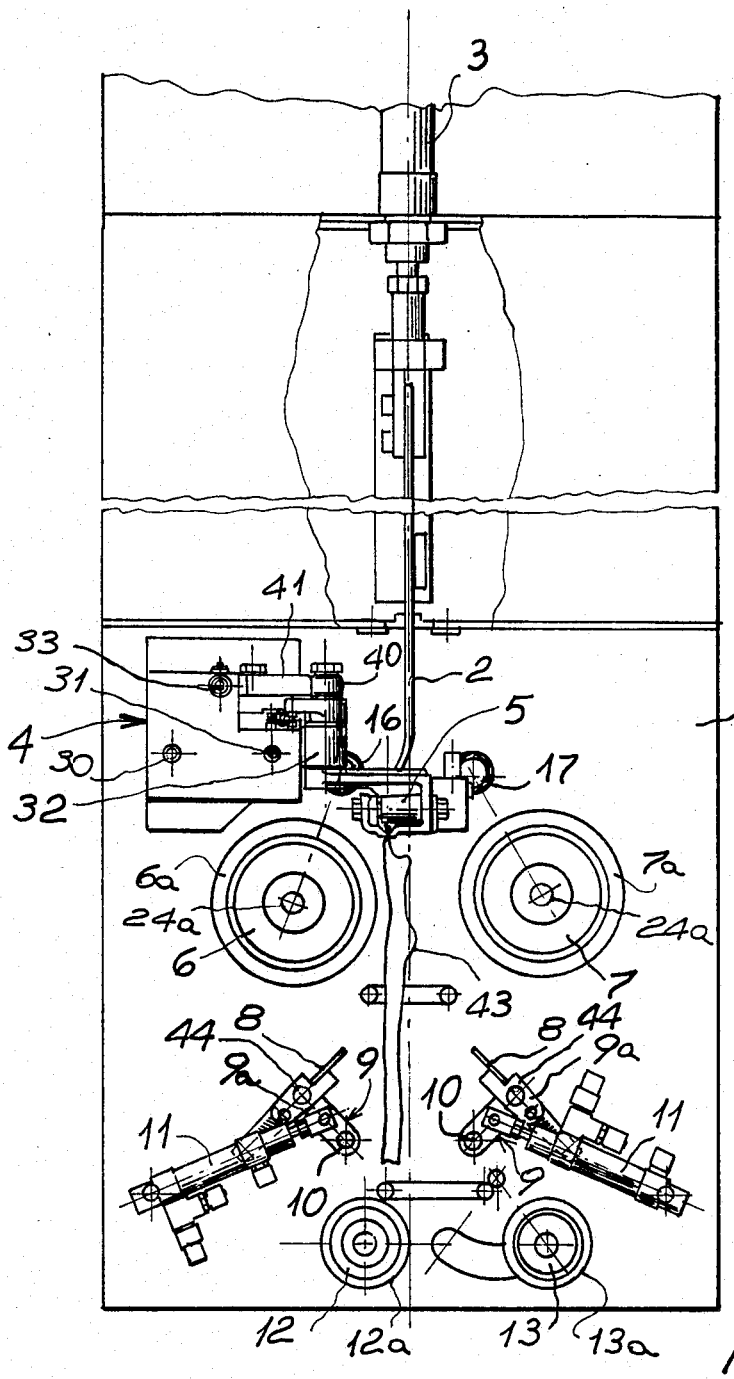
FIG. 1 is a schematic diagram of one embodiment of apparatus according to the invention.

As can be seen from FIG. 1, the apparatus comprises a frame 1, which carries a moveable blade 2 actuated by an actuator 3.

Figure 5:
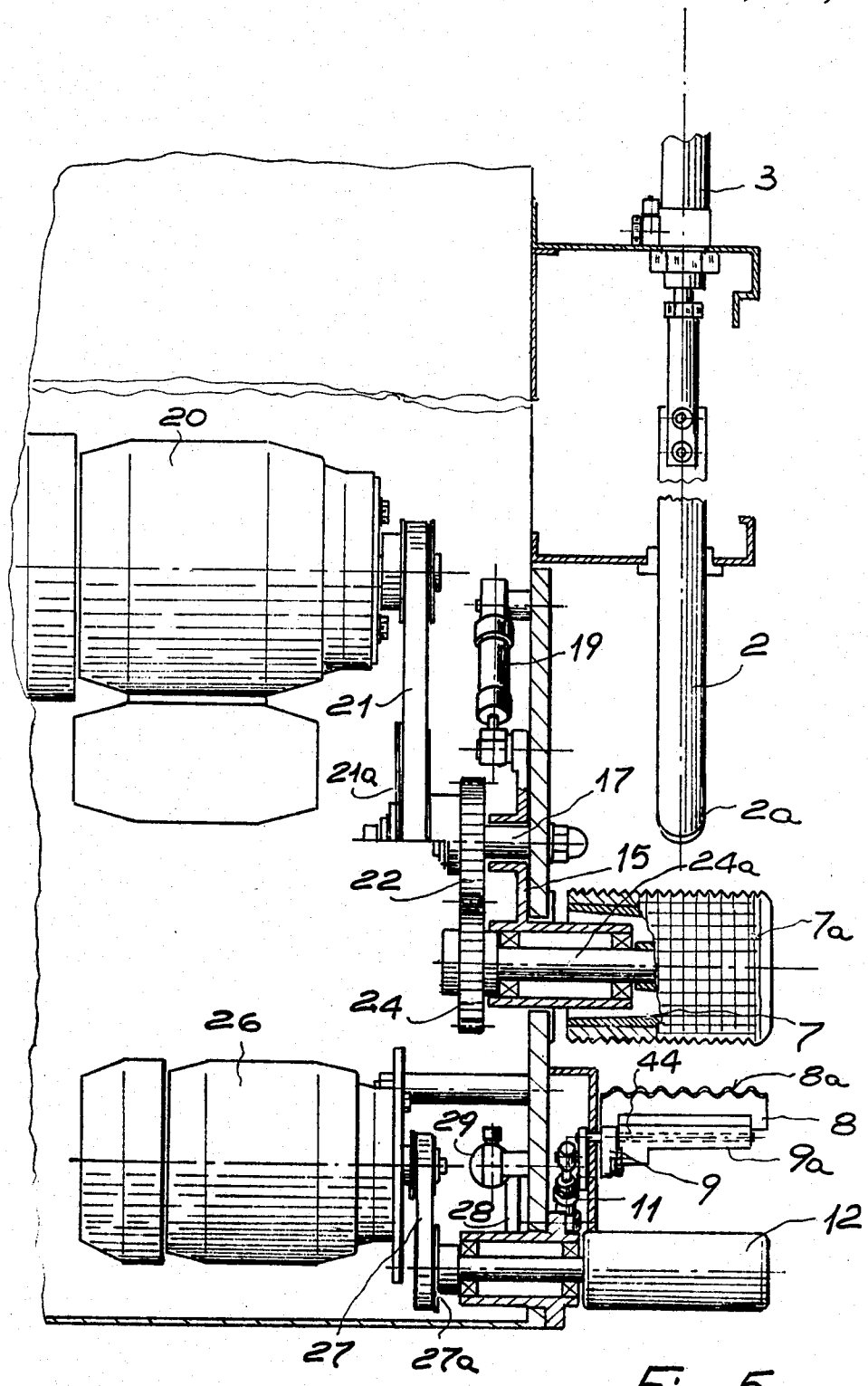
FIG. 5 is a section on the line V—V of FIG. 4, and FIGS. 6, 7, 8 and 9 show four successive operating phases of the apparatus.

The machine is provided with a feed unit 4, fitted with gripping means 5 having a fixed jaw 35*a* and a moveable jaw 35*b*. Beneath the gripping means 5 are two rollers 6, 7, provided with a covering of soft elastic material, 6*a*, 7*a* and where appropriate as shown in FIG. 5, provided with a knurled surface, depending on the type of hose to be turned.

Figure 4:
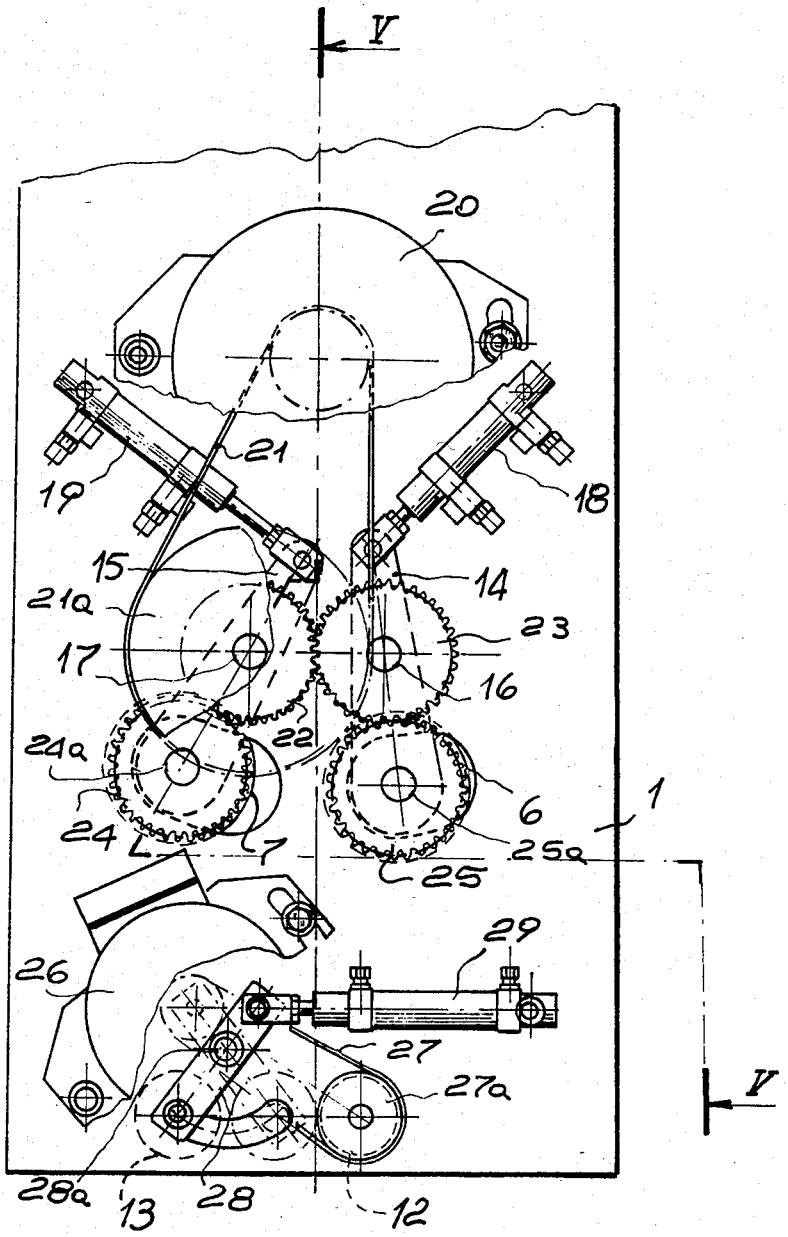
FIG. 4 is a view of internal mechanical parts of the machine.

Beneath the rollers 6, 7 there is firstly a pair of opposing plates 8, with supports 9 rotatable on pins 10, which are actuated by a pair of actuators 11 and then a second pair of rollers, 12 and 13, one 13 of which can be moved towards the other. Like rollers 6, 7, rollers 12, 13 are also fitted with a soft covering 12*a*, 13*a*. As can be seen more clearly in FIGS. 4, 5 the rollers 6, 7 are supported by lever arms 14, 15 which are mounted for rotatary about pins 16, 17 and actuated by actuators 18, 19.

Rollers 6, 7 are actuated for rotation by a motor 20, by way of a transmission belt 21, a pulley 21*a*, and a geared transmission 22, 23, 24, 25, which, on rotation of motor 20, causes simultaneous rotation of rollers 6, 7, by shafts 24*a*, 25*a* respectively, in opposite directions. Roller 12 is also actuated by a motor 26 by means of a transmission belt 27 and a pulley 27*a*. Roller 13 can be moved toward and away from roller 12 by means of a lever 28 and actuator 29.

Figure 2:
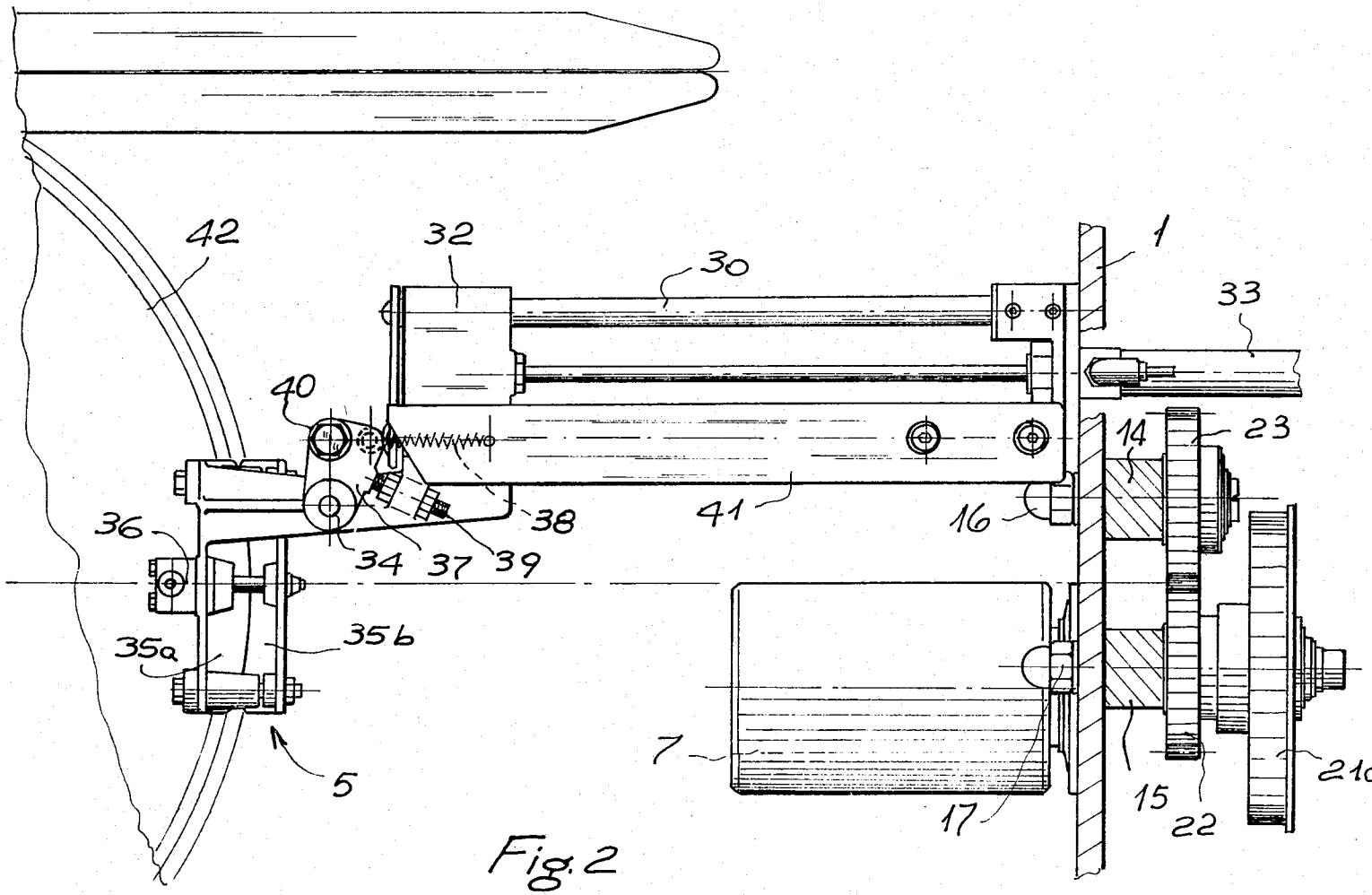
FIG. 2 is a view from about of the gripping means of the apparatus in position for the removal of a sock from a sewing machine.
Figure 3:
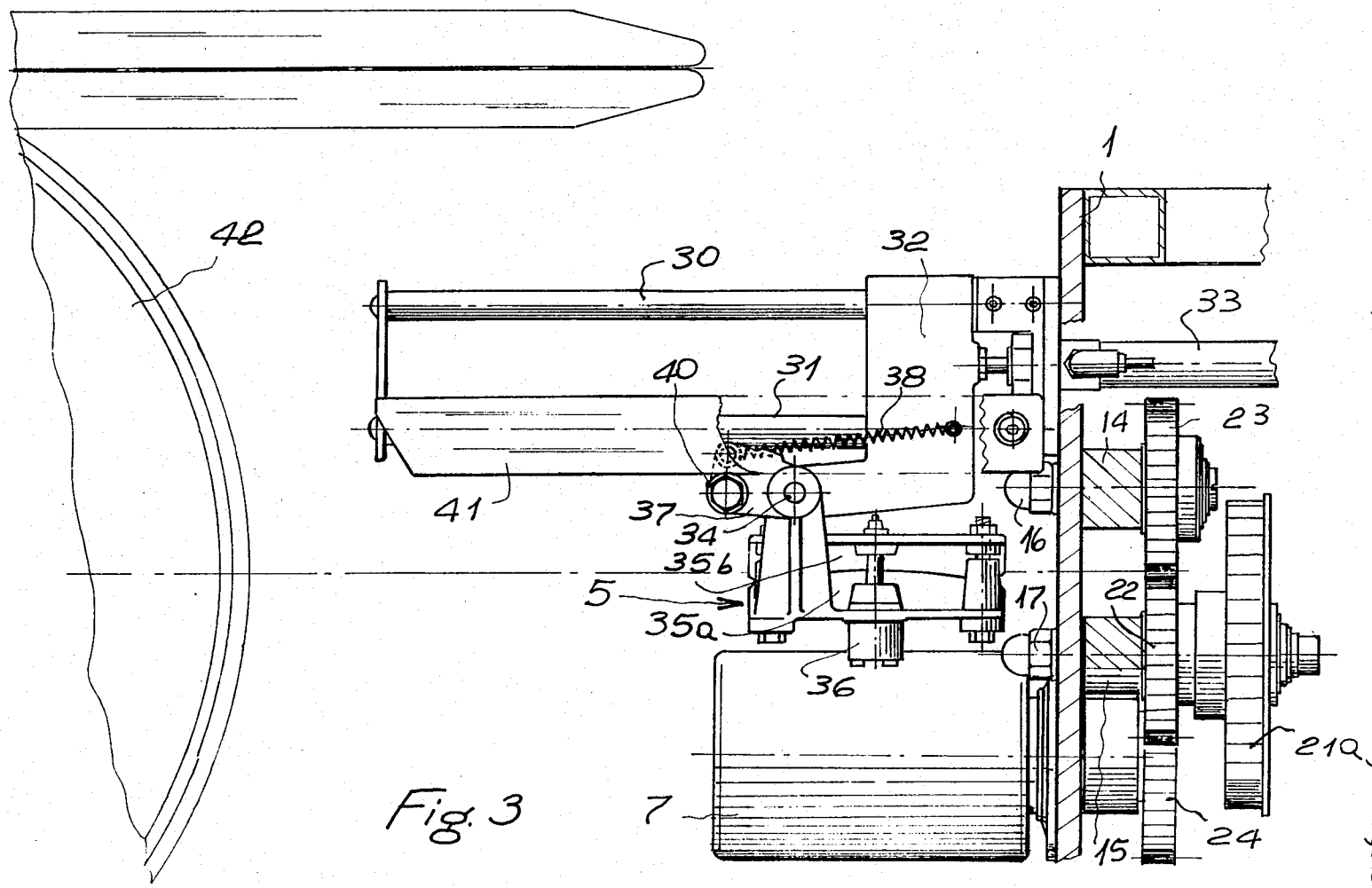
FIG. 3 is a view of the gripping means traversed into a position for the insertion of the sock between turning rollers.

The transport assembly 4 is shown in more detail in FIGS. 2 and 3. This assembly comprises a pair of guide rods 30, 31 on which a slide 32 travels, actuated by an associated actuator 33, travels to move the gripping means 5. The gripping means 5 is rotatable on pin 34, with a fixed 35*a* and a moving jaw 35*b*, by means of a servo-actuator 36. The assembly 5 is rotatable between the positions shown in FIGS. 2 and 3. The fixed jaw of collet 5 is connected rigidly to a plate 37 which is linked to slide 32 by means of a spring 38, which biases it in a transverse position, in contact with an adjusting screw 39. On plate 37 moves a roller 40 which can rest against guide 41, and in opposition to spring 38, facilitate rotation of gripping means 5 on pin 34, as can be seen in FIG. 3, when the gripping means is moved towards rollers 6 and 7.

Figure 6:
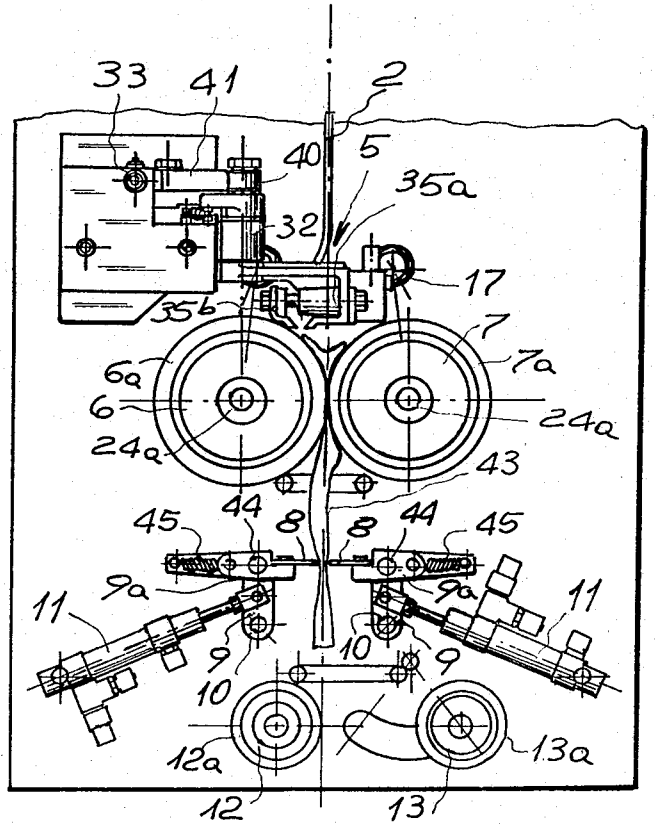

Operation of this embodiment of the machine according to the invention can be seen by referring to FIGS. 1, 2, 3, 6, 7, 8 and 9. As can be seen from FIGS. 2, 3, the machine is arranged next to a circular sewing machine, shown in part at 42, so that when actuator 33 is in the extended position, gripper 5 is positioned such that it grips the sock above machine 42 on completion of the sewing of the toe section. Actuator 33 then moves (FIGS. 1, 3) gripper 5 to a position above and between rollers 6, 7, the gripper being rotated through 90° following contact of roller 40 against guide 41, whilst rollers 6, 7 are in their spaced apart position to receive the sock 43 between them. Rollers 6, 7 are then clamped together grasping sock 43 below the toe, which, as can be seen in FIG. 6, remains with its end part or "toe-cap" in an open position, and is thus in a position to receive or accommodate the blade 2 without risk of error. The gripper 5 can then open, releasing sock 43 which is gripped firmly between the nip of the rollers 6, 7 and returned to the gripping position near the sewing machine. Hence the operating cycle of gripper 5 is fairly short as it does not involve the gripper 5 waiting for the end of the sock turning operating before being able to reposition to grip the next sock, and this contributes to the fact that the overall gripping and turning time is less than the period generally found with the sewing machine.

Figure 7:
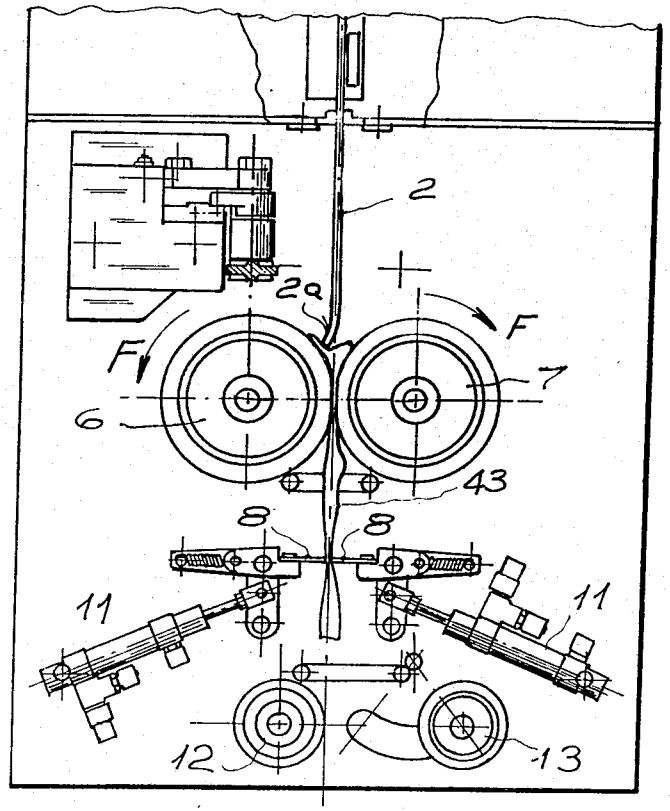
Figure 8:
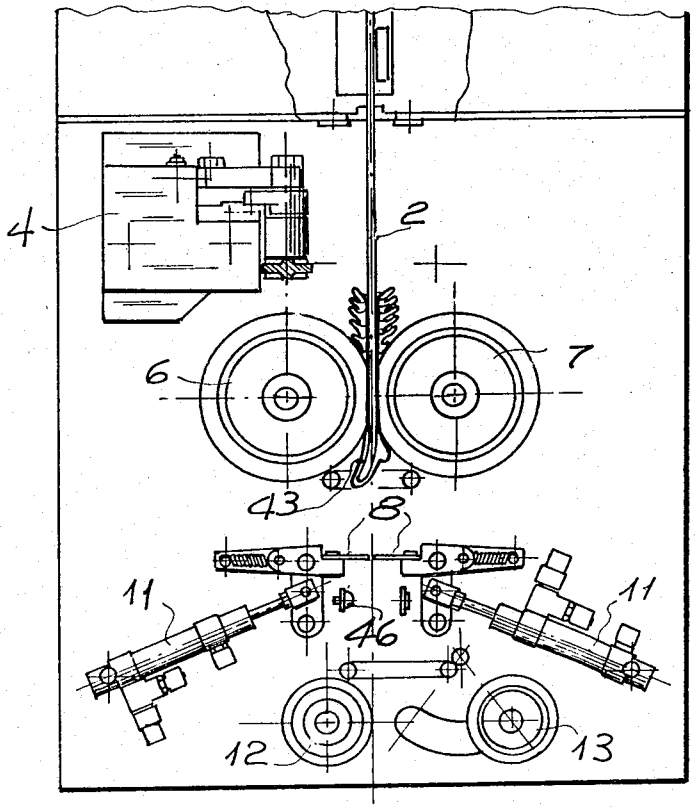

Simultaneously with the rollers 6 and 7, the opposing plates 8 clamp onto the sock, as illustrated in FIG. 6. Plates 8 are moved by section 9*a* of supports 9, as can also be seen in FIG. 5. These sections 9*a* move freely on pins 44 and are held resiliently in position by a spring 45, providing a slight retention on sock 43. This action can be assisted by a rippled surface 8*a* which may also be provided on the edge of plates 8, facilitating release of any twist in the sock. Blade 2 can then descend towards rollers, 6, 7, inserting itself between the toe-cap of the sock, as can be seen in FIG. 7. Rollers 6 and 7 then start to rotate in the direction indicated by arrows F in FIG. 7, while blade 2 continues its descent, stopping with its end just below rollers 6, 7 (FIG. 8).

Figure 9:
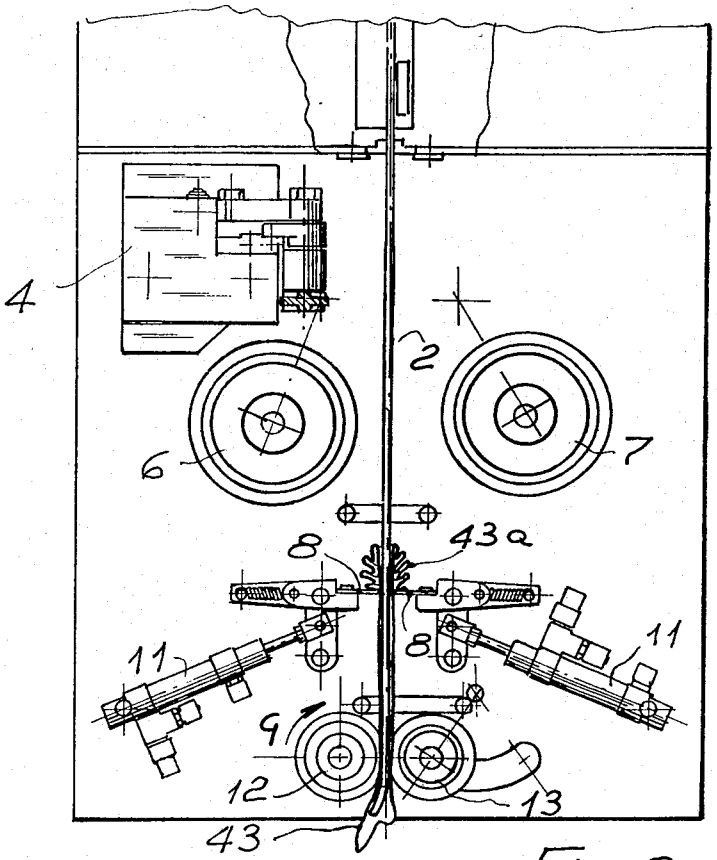

The leading end 2*a* of the blade 2 is formed with a slight curve, turned towards the back of the sock, to reduce the risk of entanglement of the blade in the heel of the sock. The rotation of rollers 6, 7 wraps the sock 43 progressively around blade 2 above the rollers; in this phase, plates 8 held flexibly in position by the associated springs 45, exercise a limited braking action on the sock, ensuring uniform winding of the sock on the blade. When a photo-electric cell type sensor 46, or similar device, registers that the sock has been rolled up above rollers 6, 7, as shown in FIG. 8, rollers 6, 7 stop and are withdrawn apart by the action of actuators 18, 19 on levers 14, 15 and the blade is then further lowered below rollers 12, 13. By the action of actuator 29, roller 13 is moved towards roller 12, which is set in rotation in the direction of arrow G (FIG. 9). The rolled up part of the sock 43*a* is held back by plates 8 and is then forced to unwind entirely until the straightened sock is completely unthreaded from blade 2, which can then return upwards, preparing for the next cycle of operation.

The apparatus also comprises control and regulating devices to regulate the successive operating phases, which can be of a known type and are not described in detail.

As can be seen from the description, the apparatus is particularly efficient as the sock is held during the entire operating cycle, avoiding any possibility of error in positioning of the sock due to faulty gripping. In addition, the toe or "toe-cap" of the sock is placed above the winding rollers, against the blade, and thus does not have to cross it, becoming squashed, or at any rate deformed, which might cause difficulties in insertion of the blade itself; the "toe-cap" of the sock is in fact expanded between the winding rollers as it was set on the sewing machine, and it is therefore more accurately positioned for receiving the blade. It is also found that the length and stroke of the blade are independent of the length of the sock to be turned and therefore the same machine can be used to turn short socks or ladies' stockings or other hose without any necessity for modification. Numerous variants can be introduced for actual production of apparatus according to this invention, for example using different motor transmission actuating mechanisms from those described, without going outside the scope of the invention in its general characteristics.

I claim:

1. An apparatus for reversing hose, comprising:

gripper means engageable with a toe of an article of hose to be reversed, with said article depending from said gripper means and shiftable horizontally from a position in which said gripper means engages said article into a reversing position;

a first pair of rollers disposed at said reversing position and receiving said article between them and relatively displaceable toward and away from one another to engage said article below said toe upon displacement of said article by said gripper means into said reversing position;

a vertically elongated blade disposed above the first pair of rollers and provided with means for lowering said blade whereby said blade is engageable with said toe of said article to carry said toe downwardly between said rollers of said first pair while counterrotation of said rollers causes said article to turn inside out along said blade; and a second pair of rollers disposed below said first pair and engageable with said article on said blade while being rotatable opposite the rollers of said first pair to draw the article, turned inside out, off said blade.

2. The apparatus defined in claim 1, further comprising a pair of blade-like stripper members flanking said blade when said blade passes beneath said first pair of rollers and engageable with said article on said blade from opposite sides to retain an open end of said article as the rollers of said second pair draw said article off said blade, said stripper members being resiliently mounted and displaceable away from a path of said blade and said article between pairs of rollers.

3. The apparatus defined in claim 2 wherein said stripper members are plates.

4. The apparatus defined in claim 3 wherein said apparatus is associated with a sewing machine for sewing a seam on said toe of said article, said position in which said gripper means engages said article being located at a perimeter of said sewing machine, said gripper means being formed with jaws having an opening plane substantially tangential to said perimeter in said position in which said gripper means engages said article, and means for swinging said jaws so that said opening plane lies substantially parallel to shafts of said rollers.

5. The apparatus defined in claim 3 in which the rollers of at least one of said pairs have a covering of a soft rubber material.

6. The apparatus defined in claim 3 wherein the rollers of at least one of said pairs have a roughened frictional surface.

7. The apparatus defined in claim 3, further comprising a pair of pivotal levers carrying the rollers of said first pair, actuator means connected to said levers for urging said levers toward and away from each other, a motor for driving said first pair of rollers, and a transmission connecting said motor with said first rollers of said first pair for counterrotation.

8. The apparatus defined in claim 3, further comprising a motor operatively connected to at least one of the rollers of said second pair for driving same.

9. The apparatus defined in claim 3, further comprising means for displacing at least one of the rollers of said second pair toward the other roller of said second pair.

10. The apparatus defined in claim 2 wherein said blade has a curved lower end portion directed toward a part of said article opposite a heel portion thereof.

* * * * *